US009145880B2

(12) United States Patent
Ellis

(10) Patent No.: US 9,145,880 B2
(45) Date of Patent: Sep. 29, 2015

(54) COMPRESSOR MANIFOLD ASSEMBLY

(75) Inventor: Mark Lee Ellis, West Olive, MI (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 345 days.

(21) Appl. No.: 13/535,632

(22) Filed: Jun. 28, 2012

(65) Prior Publication Data

US 2014/0000736 A1 Jan. 2, 2014

(51) Int. Cl.

| | |
|---|---|
| ***F04B 53/00*** | (2006.01) |
| ***F04B 39/12*** | (2006.01) |
| ***F04B 39/14*** | (2006.01) |
| ***F04B 41/06*** | (2006.01) |
| ***F25B 31/00*** | (2006.01) |

(52) U.S. Cl.

CPC ..... *F04B 39/12* (2013.01); *F04B 39/14* (2013.01); *F04B 41/06* (2013.01); *F25B 31/00* (2013.01); *F25B 2400/075* (2013.01); *Y10T 137/86163* (2015.04)

(58) Field of Classification Search

CPC .... F25B 31/00; F04B 2400/075; F04B 39/12; F04B 39/14; F04B 41/06; Y10T 137/86163

USPC ..... 417/572; 62/510, 298; 137/565.33; 138/189, 155

See application file for complete search history.

(56) References Cited

U.S. PATENT DOCUMENTS

| | | | | |
|---|---|---|---|---|
| 4,570,449 | A * | 2/1986 | Knokey et al. | 62/183 |
| 6,067,482 | A * | 5/2000 | Shapiro | 700/286 |
| 7,574,869 | B2 | 8/2009 | Shapiro | |
| 7,793,508 | B2 * | 9/2010 | Radisch | 62/150 |
| 2006/0070400 | A1 * | 4/2006 | Tamburrino | 62/504 |
| 2006/0107669 | A1 | 5/2006 | Radisch | |
| 2006/0201175 | A1 | 9/2006 | Shapiro et al. | |
| 2007/0089453 | A1 | 4/2007 | Shapiro | |
| 2010/0132390 | A1 * | 6/2010 | Platt et al. | 62/238.7 |
| 2011/0252821 | A1 | 10/2011 | Miglio | |
| 2012/0297811 | A1 * | 11/2012 | Miglio | 62/324.1 |

FOREIGN PATENT DOCUMENTS

| | | | |
|---|---|---|---|
| EP | 2 157 375 | A2 | 2/2010 |
| EP | 2 511 528 | A1 | 10/2012 |
| FR | 2 041 862 | A5 | 2/1971 |
| WO | 2012/119251 | A1 | 9/2012 |

* cited by examiner

*Primary Examiner* — Charles Freay

(74) *Attorney, Agent, or Firm* — Sutherland Asbill & Brennan LLP

(57) ABSTRACT

The present application provides a compressor manifold assembly. The compressor manifold assembly may include a suction manifold with a number of suction manifold modules, a discharge manifold with a number of discharge manifold modules, and a number of compressors positioned on the suction manifold and the discharge manifold.

17 Claims, 7 Drawing Sheets

Fig. 11
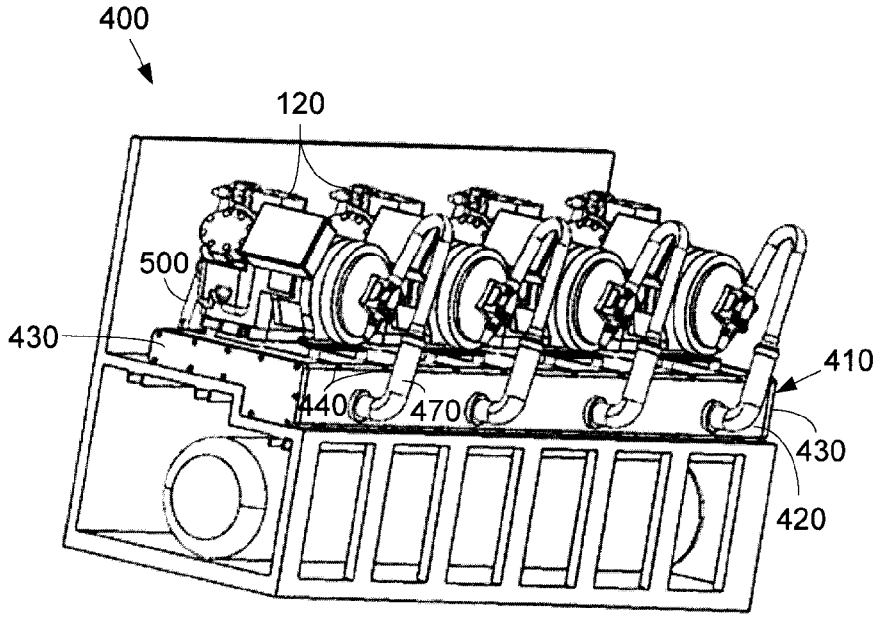
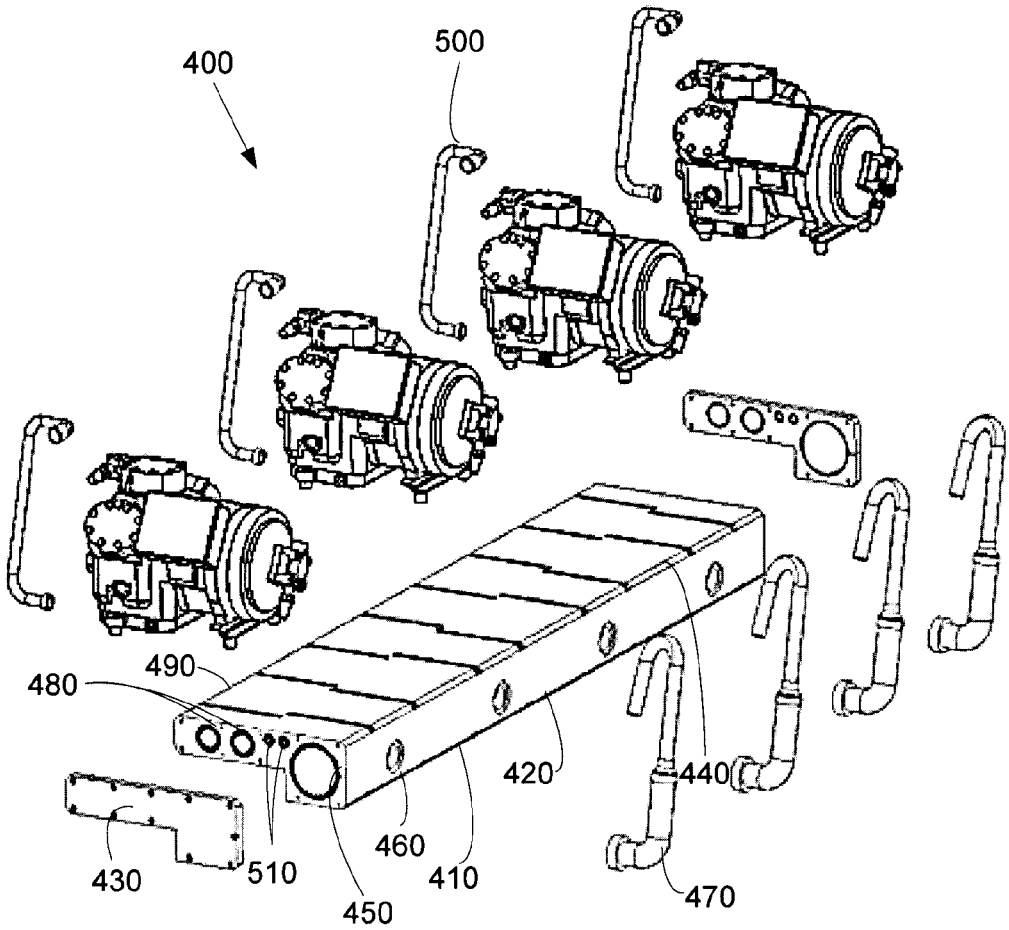
Fig. 12

COMPRESSOR MANIFOLD ASSEMBLY

TECHNICAL FIELD

The present application and the resultant patent relate generally to a compressor manifold assembly and more particularly relate to a modular compressor manifold assembly for fluid flow therein while also providing structural support and ease of assembly and use.

BACKGROUND OF THE INVENTION

Retail stores such as supermarkets and the like generally have a number of refrigerated display cases with food and/or beverages therein. A number of the refrigerated display cases may be operated within a central refrigeration system. Such a refrigeration system may include an evaporator and a fan mounted about each refrigerated display case for cooling the items therein, an external condenser, and a number of compressors. Generally described, a refrigerant fluid is heated and expanded in the evaporators while removing heat from the refrigerated display cases. The compressors compress the heated refrigerant gas and force the refrigerant to the condenser. The condenser transfers heat from the refrigerant and condenses the refrigerant such that the cycle may be repeated. The refrigeration system may use extended discharge and suction lines between the several components.

The compressors are generally arranged in a parallel configuration. Each of the compressors thus may be in communication with a discharge header and a suction header for the flow of refrigerant. Such an arrangement, however, may result in a complex configuration of compressors, piping, and the like. Moreover, all of the components generally may not be uniform such that adding or removing compressors or other components within the overall refrigeration system may be time consuming and difficult.

There is thus a desire for an improved refrigeration system in general and, more particularly, an compressor manifold assembly and configuration. Such an compressor manifold assembly and configuration may provide substantially uniform components for ease of support, installation, and repair.

SUMMARY OF THE INVENTION

The present application and the resultant patent provide a compressor manifold assembly. The compressor manifold assembly may include a suction manifold with a number of suction manifold modules, a discharge manifold with a number of discharge manifold modules, and a number of compressors positioned on the suction manifold and the discharge manifold.

The present application and the resultant patent further provide a compressor manifold assembly. The compressor manifold assembly may include a manifold, a suction conduit extending through the manifold, a discharge conduit extending through the manifold, and a number of compressors positioned on the manifold.

The present application and the resultant patent further provide a refrigeration system. The refrigeration system may include an evaporator, a condenser, and a compressor manifold assembly in communication with the evaporator and the condenser. The compressor manifold assembly may include a manifold and a number of compressors mounted on the manifold.

These and other features and improvements of the present application and the resultant patent will become apparent to one of ordinary skill in the art upon review of the following detailed description when taken in conjunction with the several drawings and the appended claims.

BRIEF DESCRIPTION OF THE DRAWINGS

FIG. 11 is a perspective view of an alternative embodiment of a compressor manifold assembly as may be described herein.

FIG. 12 is an exploded view of the compressor manifold assembly of FIG. 11.

DETAILED DESCRIPTION

Figure 1:
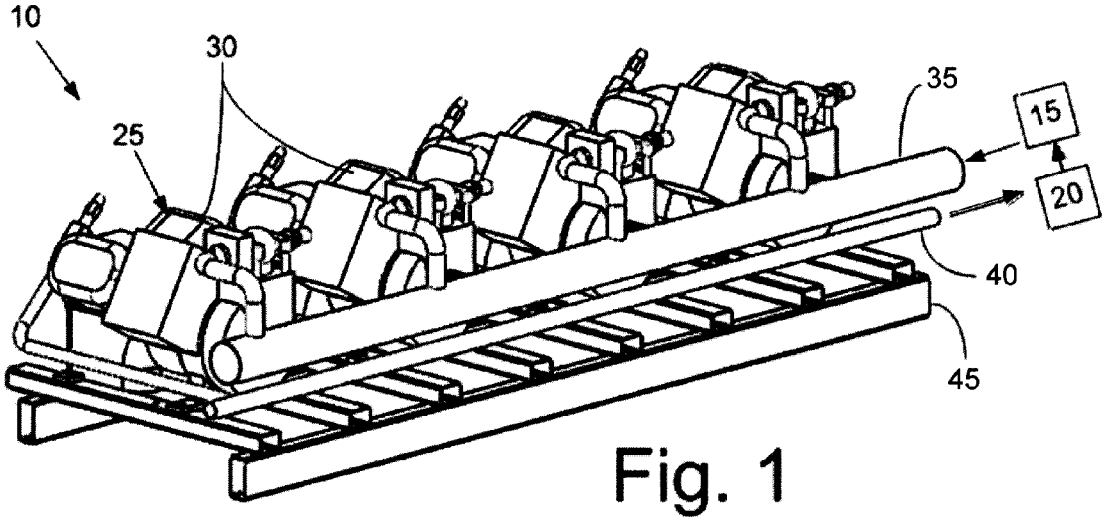
Fig. 1 PRIOR ART
FIG. 1 is a schematic diagram of a compressor assembly with a number of compressors arranged in a parallel configuration.

Referring now to the drawings, in which like numerals refer to like elements throughout the several views, FIG. 1 shows a known refrigeration system 10. As described above, the refrigeration system 10 may include an evaporator 15 to expand a refrigeration fluid and a condenser 20 to condense the fluid. The evaporator 15 and the condenser 20 may be in communication with a compressor assembly 25. The compressor assembly 25 may include a number of compressors 30 arranged in a parallel configuration. Any number of the compressors 30 may be used herein. The compressors 30 may be in communication with the refrigeration fluid from the evaporator 15 via a suction header 35 and in communication with the condenser 20 via a discharge manifold 40. Other types of conduits generally may be used for oil and other types of fluids. The compressors 30 may be positioned about a rack 45 or about other types of support structures.

Figure 2:
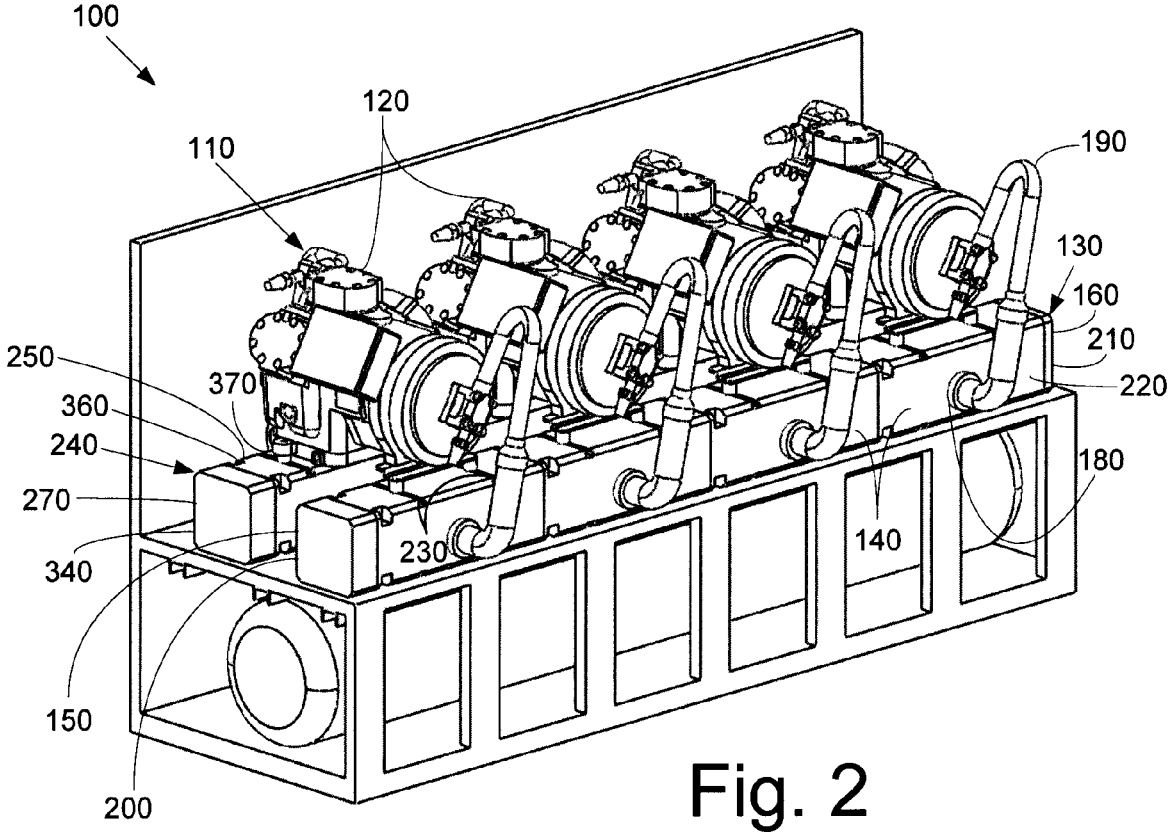
FIG. 2 is a perspective view of a compressor manifold assembly as may be described herein.
Figure 3:
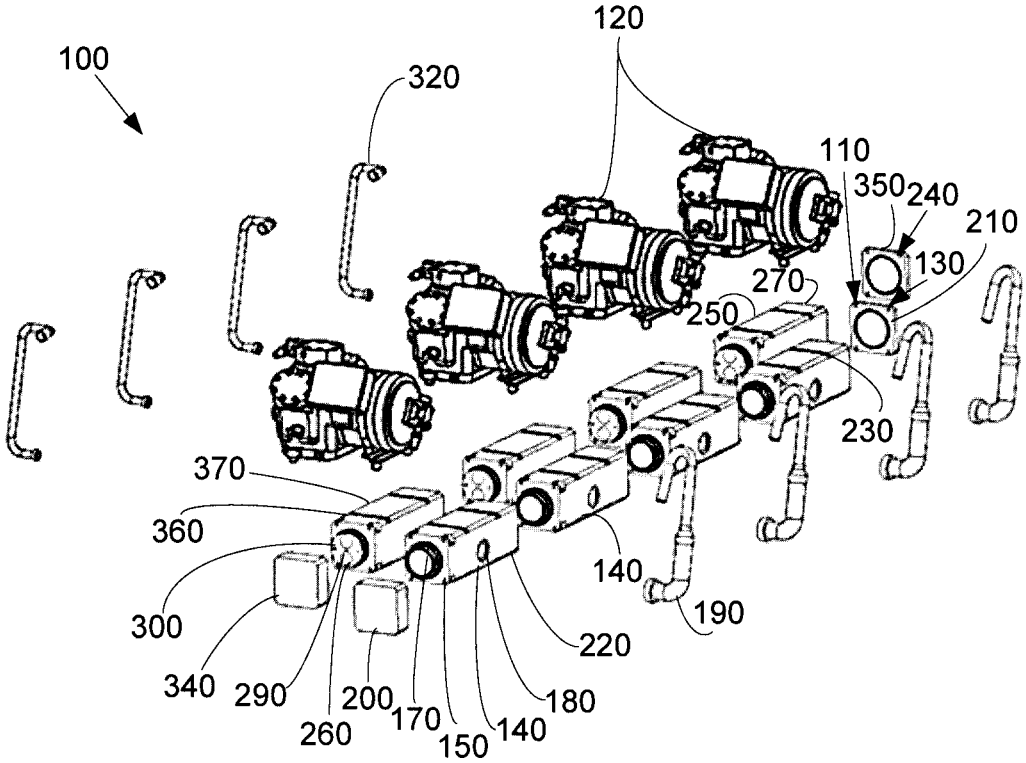
FIG. 3 is an exploded view of the compressor manifold assembly of FIG. 2.

FIGS. 2 and 3 show portions of a refrigeration system 100 as may be described herein. The refrigeration system 100 may be used with a compressor manifold assembly 110. The compressor manifold assembly 110 may include a number of compressors 120 arranged in a parallel configuration. Any number of the compressors 120 may be used herein. The refrigeration system 100 also may include one or more evaporators 15 and condensers 20 such as those described above in communication with the compressor manifold assembly 110. Other components and other configurations may be used herein.

Figure 4:
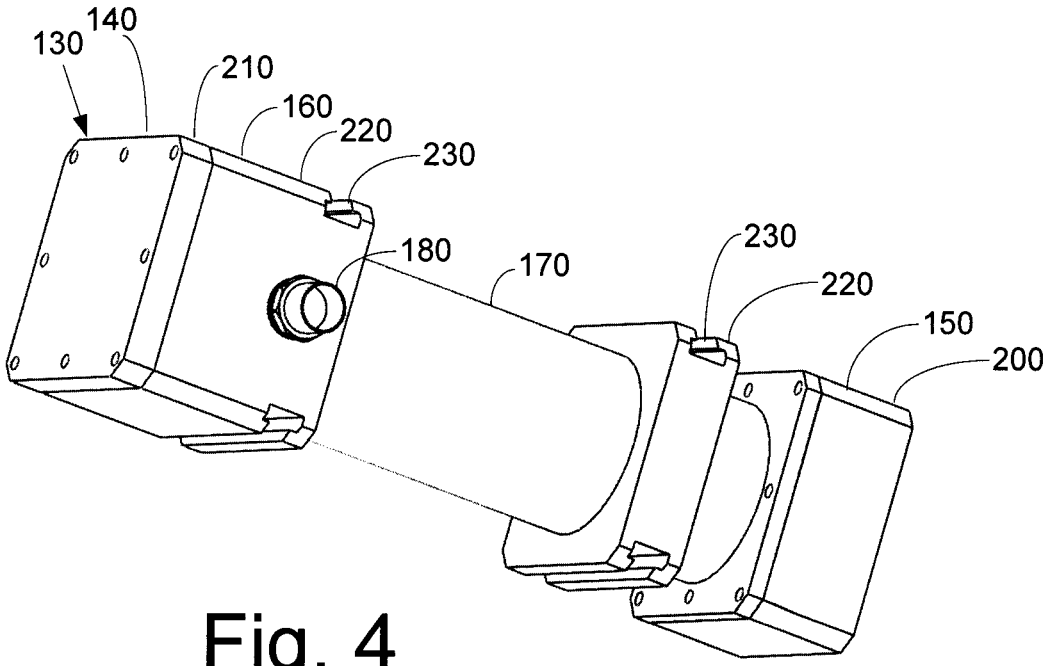
FIG. 4 is a perspective view of a suction manifold of the compressor manifold assembly of FIG. 2.
Figure 5:
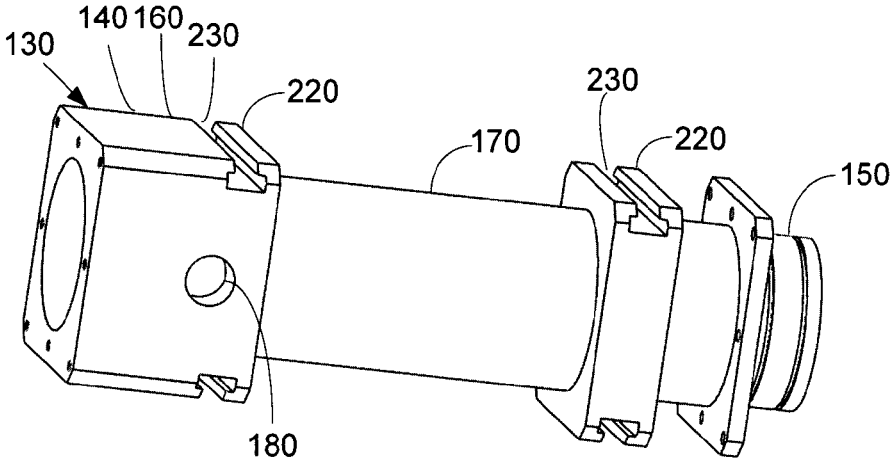
FIG. 5 is a further perspective view of the suction manifold of FIG. 4.
Figure 6:
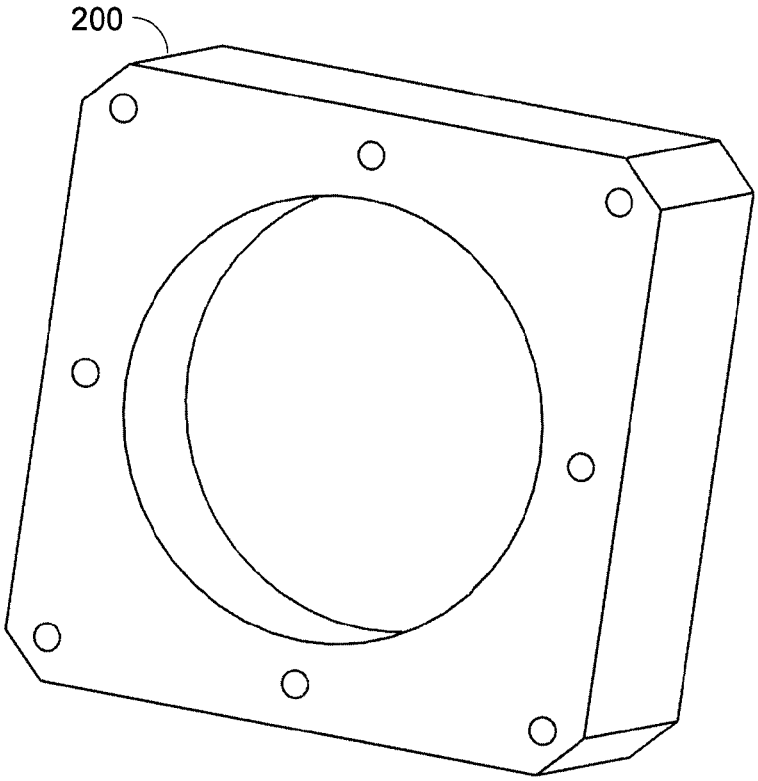
FIG. 6 is a perspective view of a female end cap of the suction manifold of FIG. 4.
Figure 7:
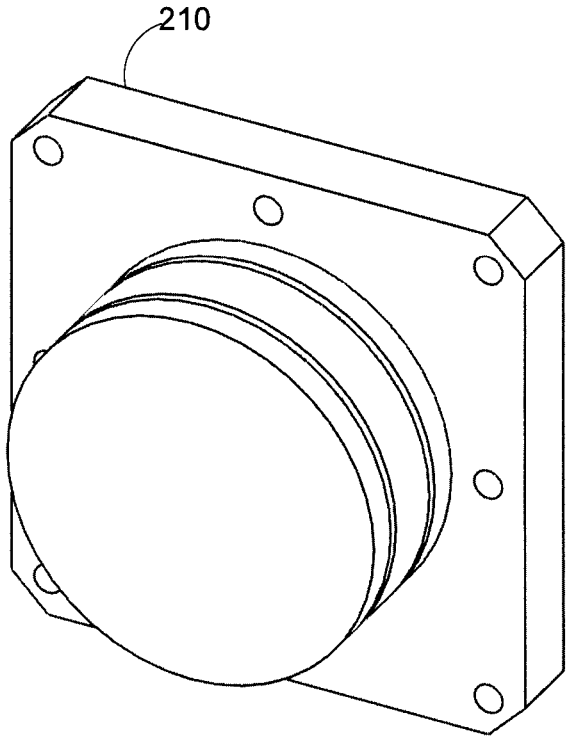
FIG. 7 is a perspective view of a male end cap of the suction manifold of FIG. 4.

The compressor manifold assembly 110 may include a number of modular components such as a suction manifold 130. The suction manifold 130 may be in communication with the evaporators 15. The suction manifold 130 may be in the form of a number of suction modules 140. Any number of the suction modules 140 may be used herein. As is shown in FIGS. 4 and 5, each suction module 140 may extend from a male end 150 to a female end 160. A central conduit 170 may extend from the male end 150 to the female end 160 for a flow of refrigerant therethrough. Each suction module 140 also may include a suction port 180 in communication with the central conduit 170. Each suction port 180 may be in communication with one of the compressors 120 via a suction pipe 190. As is shown in FIGS. 6 and 7, the ends of the suction manifold 130 may be enclosed by a male end cap 200 and a female end cap 210. Holes may be drilled through the end caps 200, 210 for the passage of the refrigerant to and from the suction manifold 130.

Each suction module 140 may include one or more support blocks 220. The support block 220 may extend the length of the suction module 140 as is shown in FIGS. 2 and 3 or a number of smaller support blocks 220 may be used as is shown in FIGS. 4 and 5. The support blocks 220 may be largely rectangular in shape although any configuration may be used. The support blocks 220 may have one or more equipment grooves 230 therein. The equipment grooves 230 may be largely T-shaped although any configuration may be used herein. A compressor 120 may be mounted about the equipment grooves 230. Each suction module 140 may be a unitary element. Alternatively, each suction module 140 may include a number of components such as the central conduit 170 and the support blocks 220 that may be attached thereto. The suction module 140 may be formed out of any substantially rigid material including metals, thermoplastics, and the like. Other components and other configurations may be used herein.

Figure 8:
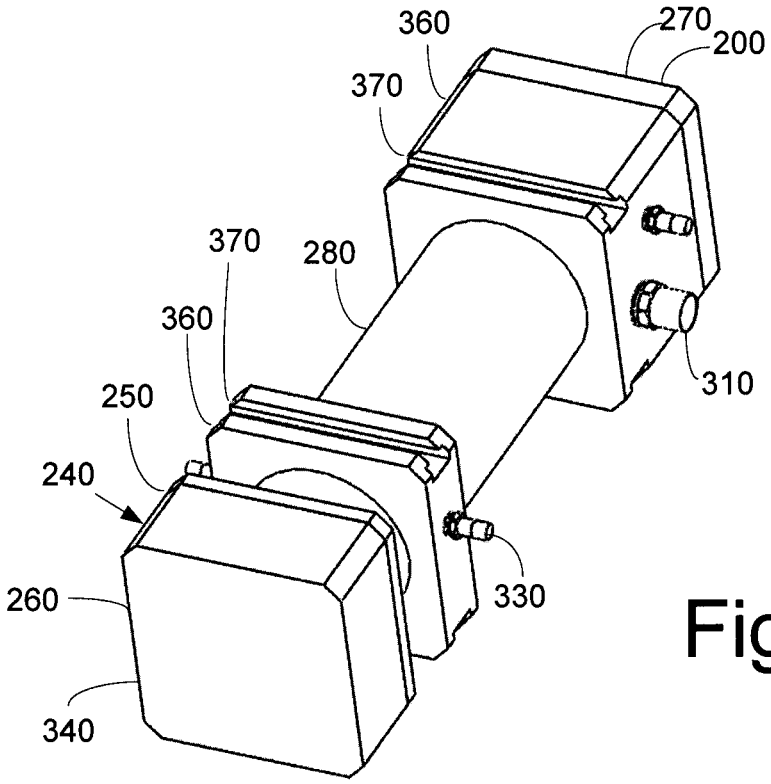
FIG. 8 is a perspective view of a discharge manifold of the compressor manifold assembly of FIG. 2.
Figure 9:
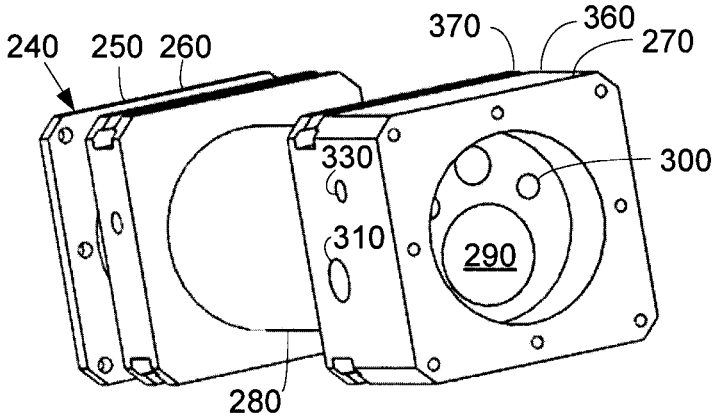
FIG. 9 is a further perspective view of the discharge manifold of FIG. 8.
Figure 10:
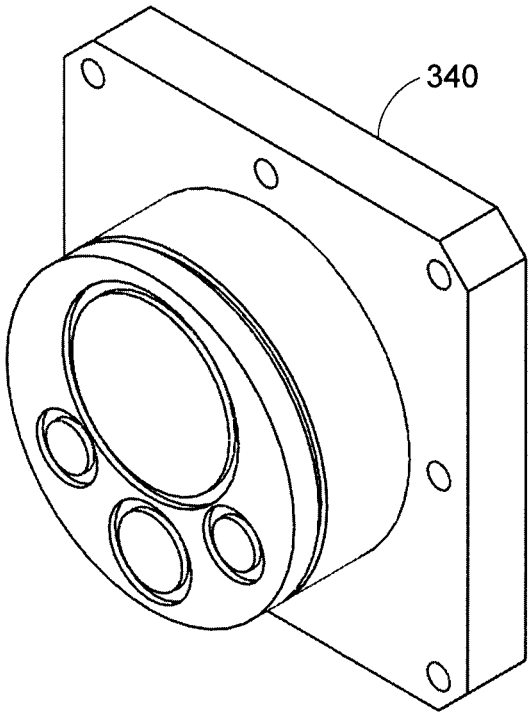
FIG. 10 is a perspective view of an end cap for use with the discharge manifold of FIG. 8.

The compressor manifold assembly 110 also may include a discharge manifold 240. The discharge manifold 240 may be in communication with the condenser 20. The discharge manifold 240 may be in the form of a number of discharge modules 250. Any number of the discharge modules 250 may be used herein. As is shown in FIGS. 8 and 9, each discharge module 250 may extend from a male end 260 to a female end 270. A central conduit 280 may extend from the male end 260 to the female end 270. The central conduit 280 may include one or more refrigerant conduits 290 for a flow of refrigerant and one or more fluid conduits 300 for a flow of other fluids therein. Each discharge module 250 may include a discharge port 310 in communication with the refrigeration conduits 290. Each discharge port 310 may be in communication with one of the compressors 120 via a discharge pipe 320. Each discharge module 250 also may have one or more fluid ports 330 in communication with one or more of the fluid conduits 300. The fluid ports 330 may be in communication with one of the compressors 120 via one or more fluid headers (not shown). As is shown in FIG. 10, the ends of the discharge manifold 240 may be enclosed by a female end cap 340 and a male end cap (similar to male end cap 200 described above). Holes may be drilled in the end caps 200, 340 for the passage of refrigerant to and from the discharge manifold 240.

Each discharge module 250 also may include one or more support blocks 360. The support blocks 360 may extend the length of the discharge module 250 as is shown in FIGS. 2 and 3 or a number of smaller support blocks 360 may be used as is shown in FIGS. 8 and 9. The support blocks 360 may be largely rectangular in shape although any configuration may be used. Each of the support blocks 360 may include one or more equipment grooves 370 thereon. The equipment grooves 370 may be largely T-shaped although other configurations may be used herein. A compressor 120 may be mounted about the equipment grooves 370. Each discharge module 250 may be a unitary element. Alternatively, each discharge module 250 may include a number of components such as the central conduit 280 and the support blocks 360 that may be attached thereto. The discharge module 250 may be formed out of any substantially rigid material including metals, thermoplastics, and the like. Other components and other configurations may be used herein.

In use, any number of the compressors 120 may be mounted about the compressor manifold assembly 110. The compressors 120 may be attached via the equipment grooves 230, 370. Each compressor 120 may be connected to a suction module 140 of the suction manifold 130 and a discharge module 250 of the discharge manifold 240. The compressor 120 may be in communication with the suction manifold 130 via the suction port 180 and the suction pipe 190. Likewise, the compressor 120 may be in communication with the discharge manifold 240 via the discharge pipe 320 and the discharge port 310. The compressor 120 also may be in communication with a flow of fluids such as oil and the like via the fluid conduit 300. The respective ends of the manifolds 130, 240 may be enclosed by the end caps 200, 210, 340. Holes may be drilled therethrough for the passage of refrigerant and the like. The number of compressors 120 in the compressor manifold assembly 110 may be varied by adding or removing a compressor 120 and the associated suction module 140 and discharge module 250. The compressor manifold assembly 110 also may accommodate other components such as filters, suction accumulators, oil systems, oil separators, receivers, and the like.

FIGS. 11 and 12 show a further embodiment of a compressor manifold assembly 400 as may be described herein. In this example, the compressor manifold assembly 400 may include a unitary manifold 410. The unitary manifold 410 may have any desired length and may be used with any number of the compressors 120. The unitary manifold 410 may include an outer shell 420. The outer shell 420 may be made out of any type of substantially rigid material including metals, thermoplastics, and the like. The outer shell 420 may be enclosed by a pair of end caps 430. The outer shell 420 may have a number of equipment grooves 440 formed therein. The equipment grooves 440 may be largely T-shaped although other configurations may be used herein. The compressors 120 may be positioned within the equipment grooves 440.

The unitary manifold 410 may include a suction conduit 450 extending therethrough. The suction conduit 450 may have any desired diameter. The unitary manifold 410 may include a number of suction ports 460. The suction ports 460 may be in communication with the suction conduit 450 and with one of the compressors 120 via a suction pipe 470. The unitary manifold 410 also may include one or more discharge conduits 480. The discharge conduits 480 may have any desired diameter. The unitary manifold 410 may include a number of discharge ports 490. The discharge ports 490 may be in communication with the discharge conduits 480 and with one of the compressors 120 via a discharge pipe 500. The unitary manifold 410 also may include a number of fluid conduits 510 extending therethrough. The unitary manifold 410 also may include a number of fluid ports (not shown) in communication with the fluid conduits 510. Other components and other configurations may be used herein.

In use, the compressor manifold assembly 400 with the unitary manifold 410 may support any number of the compressors 120. The compressors 120 may be attached via the equipment grooves 440. The respective ports and conduits may be attached in a manner similar to that described above. Moreover, all of the respective conduits are positioned within the outer shell 420 so as to eliminate multiple pipes and connections.

Figure 13:
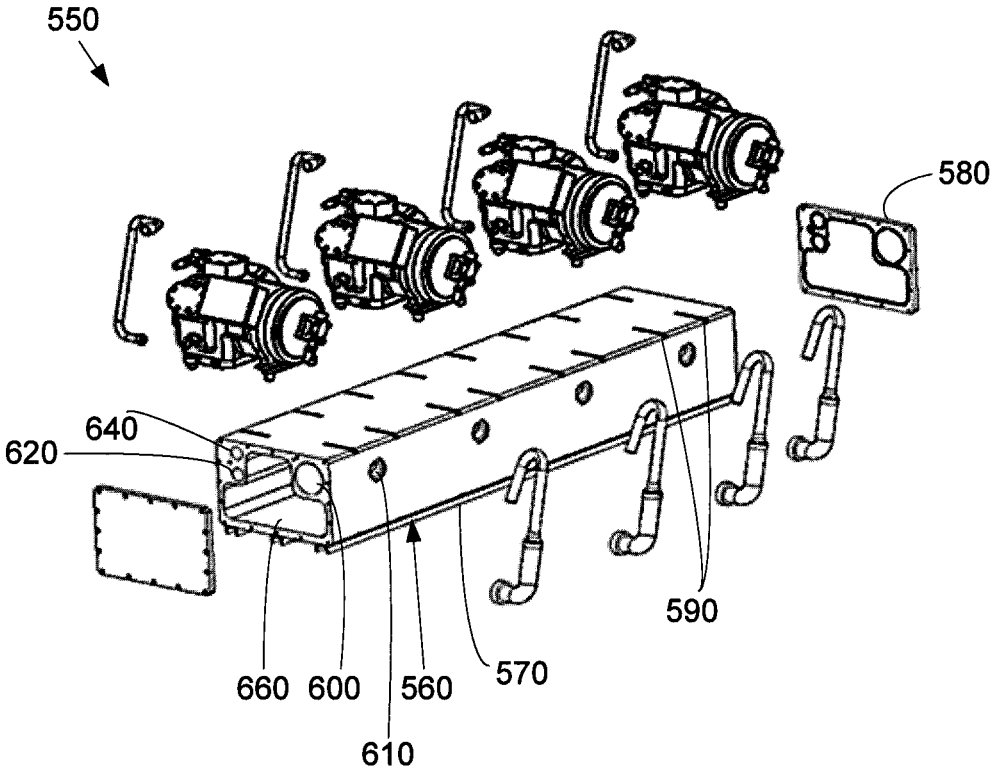
FIG. 13 is an exploded view of an alternative embodiment of a compressor manifold assembly as may be described herein.
Figure 14:
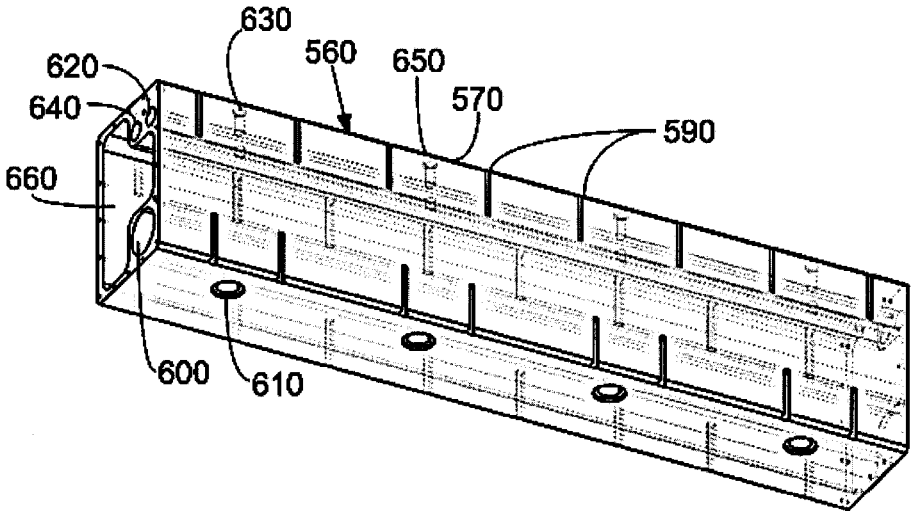
FIG. 14 is a perspective view of a unitary manifold for use with the compressor manifold assembly of FIG. 13.

FIGS. 13 and 14 show a further embodiment of a compressor manifold assembly 550 as may be described herein. In this example, the compressor manifold assembly 550 also includes a unitary manifold 560. Similar to that described above, the unitary manifold 560 includes an outer shell 570 enclosed by a pair of end caps 580. The outer shell 570 includes a number of equipment grooves 590. The unitary manifold 560 includes a suction conduit 600 in communication with a number of suction ports 610. The unitary manifold 560 likewise includes one or more discharge conduits 620 and discharge ports 630 as well as one or more fluid conduits 640 and fluid ports 650. Other components and other configurations may be used herein.

In this example, the unitary manifold 560 also includes a receiver tank 660. Generally described, a receiver tank may be positioned downstream of the condenser 20 to receive the condensate outflow therefrom. The use of the unitary manifold 560 with the internal receiver tank 660 thus eliminates a further stand alone component. Moreover, the refrigerant within the receiver tank 660 also may exchange heat with refrigerant in the suction conduit 600 or elsewhere for more efficient operation. Other components and other configurations may be used herein.

The compressor manifold assemblies described herein thus reduce and/or eliminate many of the pipes and other structures currently in use with a modular and uniform system. The compressor manifold assemblies provide structural support, uniformity, and even the ability to provide heat transfer. The compressor manifold assemblies allow for a smaller footprint while providing overall refrigeration system efficiencies.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A compressor manifold assembly, comprising:

a suction manifold with a plurality of suction manifold modules removably connected to form the suction manifold, each of the plurality of suction manifold modules comprising a first male end and a first female end configured to mate with the first male end;

a discharge manifold with a plurality of discharge manifold modules removably connected to form the discharge manifold, each of the plurality of discharge manifold modules comprising a second male end and a second female end configured to mate with the second male end, wherein the discharge manifold is spaced apart from and substantially parallel to the suction manifold; and a plurality of compressors positioned on top of the suction manifold and the discharge manifold, wherein each of the plurality of compressors comprises a plurality of projections thereon;

wherein the suction manifold comprises one or more equipment grooves on two opposite outer surfaces therein configured to receive at least one of the plurality of projections of at least one of the plurality of compressors, such that the at least one of the plurality of compressors is mounted to the top of the suction manifold.

2. The compressor manifold assembly of claim 1, wherein each of the plurality of suction manifold modules comprises a suction port in communication with one of the plurality of compressors, such that the plurality of compressors is connected in parallel to the suction manifold.

3. The compressor manifold assembly of claim 1, wherein the suction manifold comprises a pair of removably attached end caps.

4. The compressor manifold assembly of claim 1, wherein the suction manifold comprises one or more support blocks, and the one or more equipment grooves are positioned on the one or more support blocks.

5. The compressor manifold assembly of claim 1, wherein each of the plurality of discharge manifold modules comprises a discharge port in communication with one of the plurality of compressors, such that the plurality of compressors is connected in parallel to the discharge manifold.

6. The compressor manifold assembly of claim 5, wherein each of the plurality of discharge manifold modules comprises a refrigeration conduit in communication with the discharge port.

7. The compressor manifold assembly of claim 1, wherein each of the plurality of discharge manifold modules comprises a fluid port in communication with one of the plurality of compressors.

8. The compressor manifold assembly of claim 7, wherein each of the plurality of discharge manifold modules comprises a fluid conduit in communication with the fluid port.

9. The compressor manifold assembly of claim 1, wherein the discharge manifold comprises a pair of removably attached end caps.

10. The compressor manifold assembly of claim 1, wherein the discharge manifold comprises one or more support blocks.

11. The compressor manifold assembly of claim 10, wherein the one or more support blocks comprise one or more equipment grooves on two opposite outer surfaces therein for mounting one of the plurality of compressors on one of the two opposite outer surfaces.

12. A compressor manifold assembly, comprising:

a manifold comprising a plurality of suction ports and a plurality of discharge ports;

a suction conduit extending through the manifold, the suction conduit in communication with the plurality of suction ports;

a discharge conduit extending through the manifold, the discharge conduit in communication with the plurality of discharge ports, wherein the discharge conduit is positioned apart from the suction conduit; and a plurality of compressors positioned on the manifold, wherein each of the plurality of compressors is connected in parallel to the suction conduit via the plurality of suction ports and the discharge conduit via the plurality of discharge ports, each of the plurality of compressors comprises a plurality of projections thereon;

wherein the manifold comprises one or more equipment grooves on two opposite outer surfaces therein configured to receive at least one of the plurality of projections of at least one of the plurality of compressors, such that the at least one of the plurality of compressors is mounted to the top of the manifold.

13. The compressor manifold assembly of claim 12, wherein the manifold comprises a fluid conduit extending therethrough.

14. The compressor manifold assembly of claim 13, wherein the manifold comprises a plurality of fluid ports in communication with the fluid conduit.

15. The compressor manifold assembly of claim 12, wherein the manifold comprises a pair of removably attached end caps.

16. The compressor manifold assembly of claim 12, wherein the manifold comprises a receiver tank therein.

17. A refrigeration system, comprising:

an evaporator;

a condenser; and a compressor manifold assembly in communication with the evaporator and the condenser;

the compressor manifold assembly comprising a manifold and a plurality of compressors mounted on equipment grooves on top of the manifold, the equipment grooves configured to receive at least one of a plurality of projections of at least one of the plurality of compressors, wherein the manifold comprises:

a plurality of suction manifold modules removably connected to form a suction manifold, each of the plurality of suction manifold modules comprising a first male end and a first female end configured to mate with the first male end, the suction manifold in fluid communication with the evaporator;

a plurality of discharge manifold modules removably connected to form a discharge manifold, each of the plurality of discharge manifold modules comprising a second male end and a second female end configured to mate with the second male end, wherein the discharge manifold is spaced apart from and substantially parallel to the suction manifold, the discharge manifold in fluid communication with the condenser.

* * * * *